US005398522A

United States Patent [19]

Franklin, Jr.

[11] Patent Number: 5,398,522

[45] Date of Patent: Mar. 21, 1995

[54] DOUBLE END SERVICING FREIGHT CONTAINER $CO_2$ SNOW FORMING HEADER

[76] Inventor: Paul R. Franklin, Jr., 5455 Vernon Blvd., Jacksonville, Fla. 32254

[21] Appl. No.: 233,934

[22] Filed: Apr. 28, 1994

[51] Int. Cl.[6] ..... F25J 1/00; F25D 3/12

[52] U.S. Cl. ..... 62/384; 62/10; 239/14.2; 239/124; 239/128; 239/545; 239/565

[58] Field of Search ..... 239/14.2, 2.2, 124, 239/126, 421, 128, 545, 565; 62/10, 74, 347, 384

[56] References Cited

U.S. PATENT DOCUMENTS

| | | | |
|---|---|---|---|
| 2,263,913 | 11/1941 | Bargeboer | 239/124 |
| 3,815,377 | 6/1974 | Tyree, Jr. | 62/384 |
| 4,376,511 | 3/1983 | Franklin, Jr. | 239/14.2 |
| 4,462,423 | 7/1984 | Franklin, Jr. | 239/14.2 |
| 4,640,460 | 2/1987 | Franklin, Jr. | 239/2.2 |

*Primary Examiner*—Karen B. Merritt

*Attorney, Agent, or Firm*—Jacobson, Price, Holman & Stern

[57] ABSTRACT

An elongated $CO_2$ snow forming header is provided for disposition within an elongated insulated container and includes removably closable liquid $CO_2$ inlet structure at each of its opposite ends. The header includes a central longitudinal supply pipe into either end of which liquid $CO_2$ may be admitted and a pair of oppositely laterally spaced header lines supporting snow forming nozzles at points spaced longitudinally therealong for discharging jets of $CO_2$ snow onto opposite sides of the center supply line. Lateral communicating lines communicate each end of the supply line with corresponding ends of the header lines and the communicating lines open into the supply line in a manner such that rapid inflow of liquid $CO_2$ past the communicating lines causes an appreciable portion of the liquid $CO_2$ passing through the header lines to be recirculated through the center supply line.

7 Claims, 1 Drawing Sheet

DOUBLE END SERVICING FREIGHT CONTAINER $CO_2$ SNOW FORMING HEADER

BACKGROUND OF THE INVENTION

1. Field of the Invention

This invention relates to an improved apparatus for forming $CO_2$ snow within a freight container. The instant apparatus is more efficient than the apparatus disclosed in my prior U.S. Pat. No. 4,640,460, dated Feb. 3, 1987 in that the liquid $CO_2$ discharged from nozzles supported from header lines or pipes is supplied to the latter through a supply pipe onto which $CO_2$ snow discharged from the nozzles is impacted and the ends of the header pipes, from which the nozzles are supported, remote from the inlet ends thereof receiving liquid $CO_2$ from the supply pipe open into the inlet or upstream end of the supply pipe in a manner functioning as an eductor such that the rapid inflow of liquid $CO_2$ past the downstream ends of the header pipes creates a partial vacuum therein to recirculate some of the liquid $CO_2$ from the downstream ends of the header pipes into the upstream or inlet end of the supply pipe.

The recirculating liquid $CO_2$ has been previously chilled by the $CO_2$ snow impacting with the exterior of the supply pipe and thus the liquid $CO_2$ passing through the supply pipe to the header pipes is repeatedly lowered in temperature (from approximately 0° F. at 300 psig) to closely approach the triple point temperature (approximately −69° F. at 75 lbs. per sq. inch absolute). Thus, after several minutes of initial charging of a box car volume container (which process takes about 1 ½ to 2 hours) the temperature of the liquid $CO_2$ being discharged from the snow forming nozzles or heads approaches the triple point temperature and the $CO_2$ snow forming operation is therefore carried at maximum efficiency.

2. Description of Related Art

My prior U.S. Pat. No. 4,640,460 discloses the concept of discharging $CO_2$ snow directly upon opposite sides of a supply pipe through which liquid $CO_2$ under pressure flows toward header pipes from which snow forming headers or nozzles are mounted. However, U.S. Pat. No. 4,640,460 does not disclose the concept of recirculating a portion of the liquid $CO_2$ entering the supply pipe and thus the liquid $CO_2$ being discharged from the nozzles or heads is only once cooled prior to being discharged from the nozzles or heads and not accumulatively cooled as is accomplished by the recirculation feature of the instant invention.

SUMMARY OF THE INVENTION

The $CO_2$ snow forming header of the instant invention utilizes an apparatus by which $CO_2$ can be formed in the most efficient manner and the header construction is further constructed in a manner such that a freight car volume container or semitrailer volume container can be charged with $CO_2$ snow from either end of the container with equal improved efficiency.

The main object of this invention is to provide an improved method of more efficiently producing carbon dioxide snow for cooling the interiors of insulated containers.

Another object of this invention is to provide an apparatus wherein the structure required to carry out the intent of the invention is maintained extremely simple and thus quite inexpensive.

Still another object of this invention is to provide an apparatus for charging the interior of an insulated container with $CO_2$ snow in a manner wherein the production of the desired amount of $CO_2$ may be accomplished at a rapid rate.

A further important object of this invention is to provide a $CO_2$ snow forming header within an insulated container and constructed in a manner wherein by the interior may be charged with $CO_2$ snow from either end of the container.

A final object of this invention to be specifically enumerated herein is to provide an apparatus in accordance with preceding objects and which will conform to conventional forms of manufacture, be of simple construction and easy to use so as to provide a device which will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like part throughout.

DESCRIPTION OF THE PREFERRED EMBODIMENT

Figure 1:
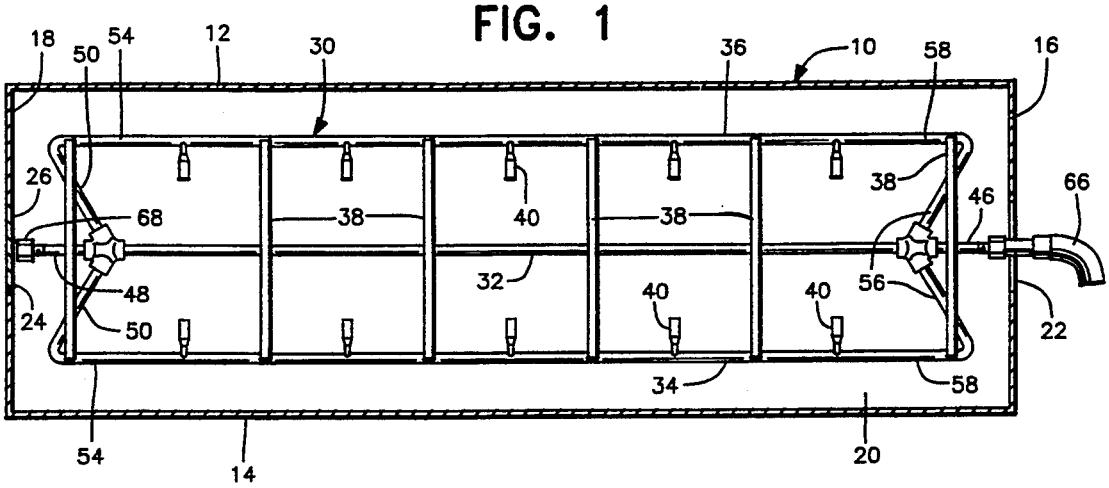
FIG. 1 is a horizontal sectional view taken through the upper portion of an insulated container and illustrating the positioning of the snow forming header of the instant invention within a typical freight container.

With reference now more specifically to FIG. 1 of the drawings, the numeral 10 generally designates an insulated freight container such as an insulated box car body or an insulated semitrailer body. Also, the container 10 may comprise any suitable form of insulated container which must be carried on some sort of transport vehicle.

The container 10 includes opposite side walls 12 and 14 as well as opposite end walls 16 and 18. The opposite side and end walls are interconnected by a bottom wall 20 and also by an upper wall (not shown).

The container 10 has access openings 22 and 24 formed in the ends walls 16 and 18 spaced closely below the upper wall (not shown) and the openings 22 and 24 each are removably closed by a closure 26, the closure for the opening 22 not being shown. The closures 26 may be hingedly, slidingly or otherwise supported from the end walls 16 and 18 for removably closing the openings 22 and 24.

The snow forming header of the instant invention is referred to in general by the reference numeral 30 and includes a central longitudinal supply pipe or line 32 and a pair of opposite side header pipes or lines 34 and 36 equally spaced on opposite sides of the supply pipe 32, transverse braces 38 extending between and being secured to the supply pipe 32 and the header pipes 36 in order to maintain the relative positions thereof.

Figure 2:
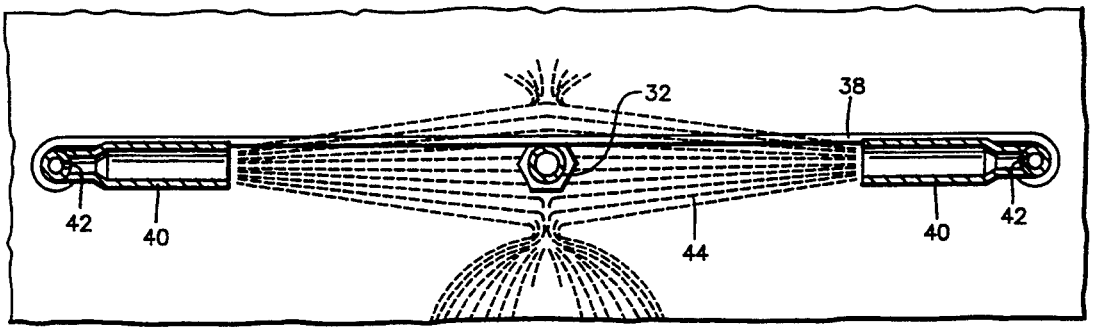
FIG. 2 is an enlarged vertical sectional view illustrating the manner in which the supply and header pipes are braced relative to each other and the manner in which the nozzles carried by the header pipes discharge $CO_2$ snow onto the opposite sides of the supply pipe.

Each of the header pipes 34 and 36 includes a plurality of snow forming nozzles or heads 40 supported therefrom at points spaced longitudinally therealong and the header pipes 34 and 36 open into the inlet ends of the nozzles 40 as at 42 for discharge of liquid $CO_2$ from the header pipes 36 and the formation of $CO_2$ snow within the nozzles 40 and pressured discharge of $CO_2$ snow from the nozzles 40 onto opposite sides of the supply pipe 32 and for impacting of the jets 44 of $CO_2$ snow discharged from corresponding nozzles 40 supported from the header pipes 34 and 36 impacting with each other above and below the supply pipe 32, see FIG. 2.

For the purpose of describing the operation of the snow forming header 30 as illustrated in FIG. 1, the supply pipe 32 includes a first upstream end 46 and a second downstream end 48 and communicating pipes or lines 50 communicate the second downstream end 48 of the supply pipe 32 with the inlet or upstream ends 54 of the header pipes 34 and 36. Also, communicating pipes 56 communicate the outlet or downstream ends 58 of the header pipes 34 and 36 with the first or upstream end 46 of the supply pipe 32.

Figure 3:
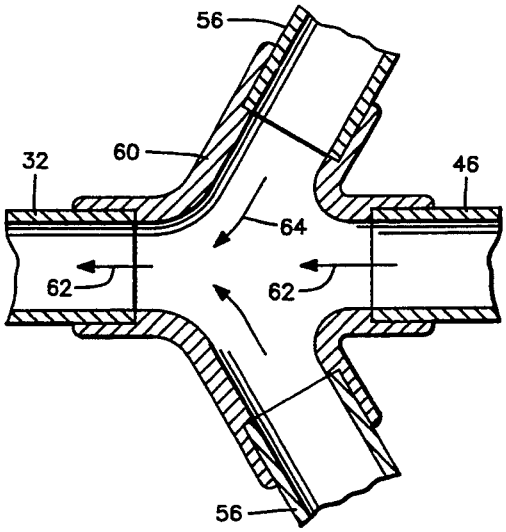
FIG. 3 is a fragmentary enlarged horizontal sectional view illustrating the manner in which the communicating pipes communicate the downstream ends of the header pipes with the upstream or inlet end of the supply pipe in a manner to effect recirculation of liquid $CO_2$ from the downstream ends of the header pipes into the upstream end of the supply pipe.

With attention invited more specifically to FIG. 3, it will be seen that the upstream or first inlet end 46 of the supply pipe 32 is communicated with the intermediate length portion of the supply pipe 32 through a fittings 60 and that the ends of the communicating lines or pipes 56 opening into the supply pipe 32 are inclined at approximately 60° relative to the upstream direction of the supply pipe 32. Thus, as liquid $CO_2$ passes through the supply pipe 32 in the direction of the arrows 62 illustrated in FIG. 3, an eductor action is created whereby excess liquid $CO_2$ in the communicating lines or pipes 56 is drawn into the supply pipe 32 as indicated by the arrows 64 in FIG. 3. Thus, a considerable portion of the liquid $CO_2$ entering the first inlet or upstream end 46 of the supply pipe 32 is caused to recirculate through the latter. As this recirculation occurs, inasmuch as liquid $CO_2$ passing downwardly through the supply pipe 32 is chilled by the jets 44 of $CO_2$ snow impacting with the supply pipe 32, the liquid $CO_2$ entering the supply pipe 32 through the communicating lines or pipes 56 is at a lower temperature than the liquid $CO_2$ within the supply pipe 32 upstream from the fitting 60.

Thus, the 0° F. liquid $CO_2$ entering the inlet end of the supply pipe 32 at 300 psig upstream from the fitting 60 has chilled liquid $CO_2$ mixed therewith within the fitting 60. Thus, the first recirculation path of liquid $CO_2$ lowers the temperature of the liquid $CO_2$ thereafter flowing through the supply pipe 32 between the fittings 60. Then, as that further chilled liquid $CO_2$ has portions thereof recirculated with the liquid $CO_2$ entering the inlet end of the supply pipe 32 upstream from the fittings 60, the liquid $CO_2$ flowing through the supply pipe 32 between the fittings 60 is even further chilled and this progressive chilling effect is carried out through the initial portion of the time period it takes to charge the interior of the container 10 with the desired quantity of $CO_2$ snow. In practice, the temperature of liquid $CO_2$ passing through the supply pipe 32 before entering the header pipes 34 and 36 has its temperature reduced from 0° F. to generally −40° F. and greater temperature reduction can be realized by increasing the number of spray heads 40. Increasing the number of spray heads 40 for a given length of header not only enables the container 10 to be more rapidly charged with the desired quantity of $CO_2$ snow, but also results in a greater temperature reduction of the liquid $CO_2$ passing through the supply pipe 32 by the increased number of jets of $CO_2$ snow impacting with the supply pipe 32. Also, the velocity of liquid $CO_2$ through the fittings 60 is increased and a larger volume of liquid $CO_2$ is recirculated through the fittings 60 for a given period of time to thus further reduce the temperature of liquid $CO_2$ passing through the supply pipe 32.

With attention now invited more specifically to FIG. 1, it will be noted that the supply hose 66 supplying liquid $CO_2$ under pressure from a remote source (not shown) of liquid $CO_2$ is removably threadedly engaged with the inlet end 46 of the supply pipe 32. Also, it will be noted that the second downstream end 48 of the supply pipe 32 is removably closed by a threaded cap 68 spaced closely inward of the closure 26. Accordingly, if desired, the inlet end 46, after removal of the supply hose 66, may be removably closed by a second threaded cap (now shown) corresponding to the cap 68 and the cap 68 may be removed for the purpose threadedly connecting the supply hose 66 to the end 50 of the supply pipe 32 through the opening 24 subsequent to removable of the closure 26. In this manner, operation of the header 30 may be effected through the opening 24 for the purpose of charging the interior of the container 10 with $CO_2$ snow in exactly the same manner, except that the flow of liquid $CO_2$ through the header 30 is reversed.

It is also pointed out that although the communicating lines or pipes 50 and 56 are inclined 60° relative to the inflow of liquid $CO_2$ through the fittings 60, recirculation of liquid $CO_2$ is possible even if the communicating pipes 50 and 56 open into the fittings 60 at 90° relative to the supply pipe 32.

The foregoing is considered as illustrative only of the principles of the invention. Further, since numerous modifications and changes readily will occur to those skilled in the art, it is not desired to limit the invention to the exact construction and operation shown and described, and accordingly, all suitable modifications and equivalents may be resorted to, falling within the scope of the invention.

What is claimed as new is as follows:

1. A $CO_2$ snow forming system including a supply line having first and second ends, said first end including inlet means for admitting liquid $CO_2$ therein and said second end being closed, a header line generally paralleling said supply line and including outlet and inlet ends corresponding to said first and second ends, respectively, a first pair of communicating pipes, one of said communicating pipes opening into and communicating said second end with said inlet end, the other of said communicating pipes opening into and communicating said outlet end with said first end, said header line including a plurality of $CO_2$ snow forming nozzles supported therefrom at points spaced longitudinally therealong and opening outwardly of said header line toward said supply line and operative to discharge jets of $CO_2$ snow onto said supply line, said other communicating pipe opening into said supply line in a manner defining eductor means operative to draw liquid $CO_2$ into said first end of said supply line from said other communicating pipe responsive to rapid flow of liquid $CO_2$ within said supply line from said first end toward said second end.

2. The $CO_2$ snow forming system of claim 1 wherein said other communicating pipe opens into said first end of said supply line in a direction forming an acute angle with the upstream direction of said supply line.

3. The $CO_2$ snow forming system of claim 1 including a second header line generally paralleling said supply line on the side thereof opposite the first mentioned header line and having inlet and outlet ends, a second pair of communicating pipes, one of said second pair of communicating pipes communicating said second end with said inlet end of said second header line and the other of said second pair of communicating pipes communicating said first end with said outlet end of said second header line, said second header line including a plurality of snow forming nozzles supported therefrom at points spaced longitudinally therealong opening outwardly of said second header line towards said supply line and operative to discharge jets of $CO_2$ snow onto said supply line, said other communicating pipe of said second pair of communicating pipes opening into said supply line in a manner defining eductor means operative to draw liquid $CO_2$ into said first end of said supply line from said other communicating pipe of said second pair of communicating pipes responsive to rapid flow of liquid $CO_2$ within said supply line from said first end toward said second end.

4. The $CO_2$ snow forming system of claim 3 wherein the snow forming nozzles supported from said header lines oppose each other and are spaced from said supply line such that the $CO_2$ snow discharged from the nozzles supported from each header line impacts with the $CO_2$ snow discharged from the corresponding nozzles of the other header line.

5. The $CO_2$ snow forming system of claim 3 wherein said second end of said supply line is removably closed and includes inlet means for admitting liquid $CO_2$ therein and said first end of said supply line is removably closable.

6. The $CO_2$ snow forming system of claim 3 wherein said communicating pipes of said first and second pairs of communicating pipes adjacent said second end of said supply line open into said supply line in a manner defining eductor means operative to draw liquid $CO_2$ into said second end of said supply line from the adjacent communicating lines responsive to rapid flow of liquid $CO_2$ within said supply line from said second end toward said first end.

7. A $CO_2$ snow forming system including a central supply line including first and second ends, a pair of header lines generally paralleling and spaced on opposite sides of said supply line, each of said header lines including a plurality of $CO_2$ snow forming nozzles spaced longitudinally therealong and supported and opening outwardly from said header line toward said supply line, first communicating means communicating said first end of said supply line with the corresponding ends of said header lines and second communicating means communicating said second end of said supply line with the corresponding ends of said header lines, each end of said supply line being removably closed and including liquid $CO_2$ inlet means, said first and second communicating means opening into said supply line in a manner defining eductor means operative to draw liquid $CO_2$ into said supply line from the corresponding communicating means responsive to rapid flow of liquid $CO_2$ through said supply line from past said corresponding communicating means toward the other of said first and second communicating means.

* * * * *